US008690138B2

(12) United States Patent
Lin et al.

(10) Patent No.: US 8,690,138 B2
(45) Date of Patent: Apr. 8, 2014

(54) COAXIAL CONCENTRIC DOUBLE-JAW VICE

(75) Inventors: Tseh-Pei Lin, Taichung Hsien (TW); Chang-Yi Lin, Taichung Hsien (TW)

(73) Assignee: Tseh-Pei Lin, Taichung Hsien (TW)

( * ) Notice: Subject to any disclaimer, the term of this patent is extended or adjusted under 35 U.S.C. 154(b) by 595 days.

(21) Appl. No.: 12/980,995

(22) Filed: Dec. 29, 2010

(65) Prior Publication Data

US 2012/0169000 A1 Jul. 5, 2012

(51) Int. Cl.
*B25B 1/10* (2006.01)

(52) U.S. Cl.
USPC ..... 269/240; 269/244; 269/246

(58) Field of Classification Search
USPC ..... 269/216, 218, 224, 240, 242, 244, 257
See application file for complete search history.

(56) References Cited

U.S. PATENT DOCUMENTS

| | | | | | |
|---|---|---|---|---|---|
| 3,208,316 | A | * | 9/1965 | Scribner | 81/476 |
| 3,650,522 | A | * | 3/1972 | Wermuth et al. | 269/228 |
| 4,046,364 | A | * | 9/1977 | Coope et al. | 269/244 |
| 4,299,377 | A | * | 11/1981 | Lenz | 269/136 |
| 4,438,911 | A | * | 3/1984 | McDougal | 269/32 |
| 4,529,183 | A | * | 7/1985 | Krason et al. | 269/43 |
| 4,605,208 | A | * | 8/1986 | Durham | 269/32 |
| 4,899,999 | A | * | 2/1990 | Arnold | 269/240 |
| 5,171,004 | A | * | 12/1992 | Berchtold | 269/228 |
| 5,192,062 | A | * | 3/1993 | Berchtold | 269/244 |
| 5,251,887 | A | * | 10/1993 | Arnold et al. | 269/221 |
| 5,351,943 | A | * | 10/1994 | Milz | 269/246 |
| 5,374,040 | A | * | 12/1994 | Lin | 269/43 |
| 5,683,077 | A | * | 11/1997 | Fink et al. | 269/244 |
| 6,206,354 | B1 | * | 3/2001 | Lin | 269/43 |
| 8,052,130 | B2 | * | 11/2011 | Huang | 269/244 |
| 2012/0169000 | A1 | * | 7/2012 | Lin et al. | 269/216 |

FOREIGN PATENT DOCUMENTS

| | | | |
|---|---|---|---|
| EP | 582792 | A1 * | 2/1994 |

* cited by examiner

*Primary Examiner* — Lee D Wilson
*Assistant Examiner* — Jamal Daniel
(74) *Attorney, Agent, or Firm* — Muncy, Geissler, Olds & Lowe, P.C.

(57) ABSTRACT

A coaxial concentric double-jaw vice comprises a base frame defining a longitudinal sliding groove, first and second movable jaws mounted on the base frame and movable along the sliding groove, a control rod set inserted through the first and second movable jaws and received in the sliding groove, a fixed screw rod mounted on the control rod set and screw-connected with the first movable jaw, a movable screw rod sleeved onto the control rod set and screw-connected with the second movable jaw and rotatable with the control rod set and movable axially along the control rod set by an external force, a clutch mounted in the control rod set, and a driving mechanism mounted in the control rod set and connectable to the control rod set by the clutch for rotating the control rod set.

9 Claims, 5 Drawing Sheets

COAXIAL CONCENTRIC DOUBLE-JAW VICE

BACKGROUND OF THE INVENTION

1. Field of the Invention

The present invention relates to vices and more particularly, to a coaxial concentric double jaw vice.

2. Description of the Related Art

Commercial double jaw vices are basically similar, commonly comprising a fixed jaw and a movable jaw movable along the top side of the vice by a screw rod so that the workpiece can be held firmly by the fixed jaw and the movable jaw. However, after the workpiece is clamped in the vice, an extra pressure must be applied to rotate the screw rod further and to enhance the clamping force. At this time, the workpiece may receive an overpressure, resulting in a bad affect. To avoid this problem, the invention studied the use of a clutch and a driving mechanism in a vice.

Further, conventional multi-power CNC super vices are known using a pressure intensifier to drive a driving barrel in rotating the screw rod to enhance the workpiece clamping force. However, due to the effect of the pressure intensifier, the pressure at the inside of the screw rod and the pressure at the outside of the screw rod may be unbalanced, causing deformation of the screw rod. The invention also eliminates this problem.

SUMMARY OF THE INVENTION

The present invention has been accomplished under the circumstances in view. It is the main object of the present invention to provide a coaxial concentric double jaw vice, which can be rapidly closed to pre-clamp the workpieces and then operated to enhance the clamping force, achieving convenient and rapid operation.

To achieve this and other objects of the present invention, a coaxial concentric double jaw vice comprises a base frame defining a longitudinal sliding groove, first and second movable jaws mounted on the base frame and movable along the sliding groove, a control rod set inserted through the first and second movable jaws and received in the sliding groove, a fixed screw rod mounted on the control rod set and screw-connected with the first movable jaw, a movable screw rod sleeved onto the control rod set and screw-connected with the second movable jaw and rotatable with the control rod set and movable axially along the control rod set by an external force, a clutch mounted in the control rod set, and a driving mechanism mounted in the control rod set and connectable to the control rod set by the clutch for rotating the control rod set.

DETAILED DESCRIPTION OF THE INVENTION

Figure 1:
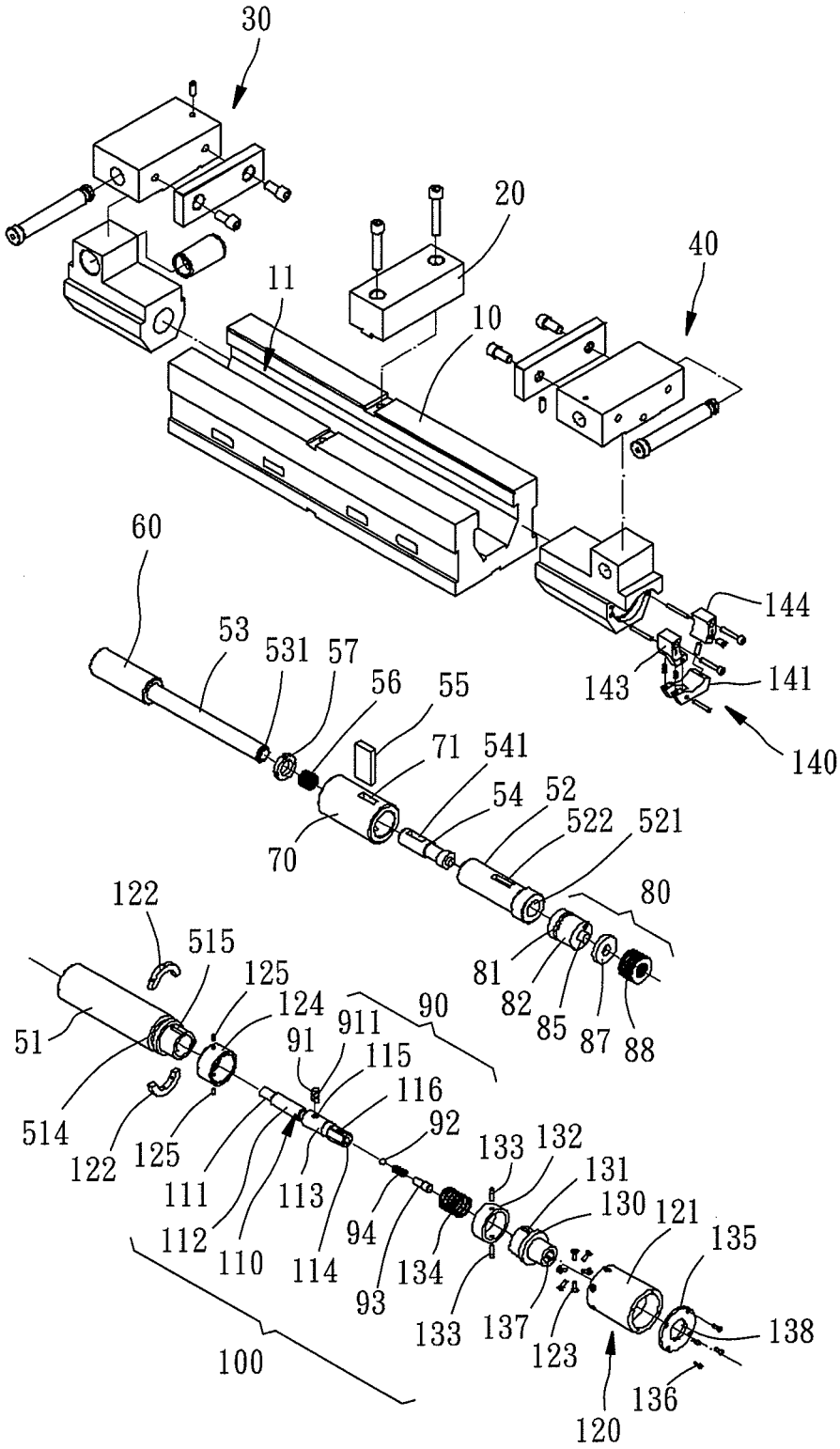
FIG. 1 is an exploded view of a coaxial concentric double jaw vice in accordance with the present invention.
Figure 2:
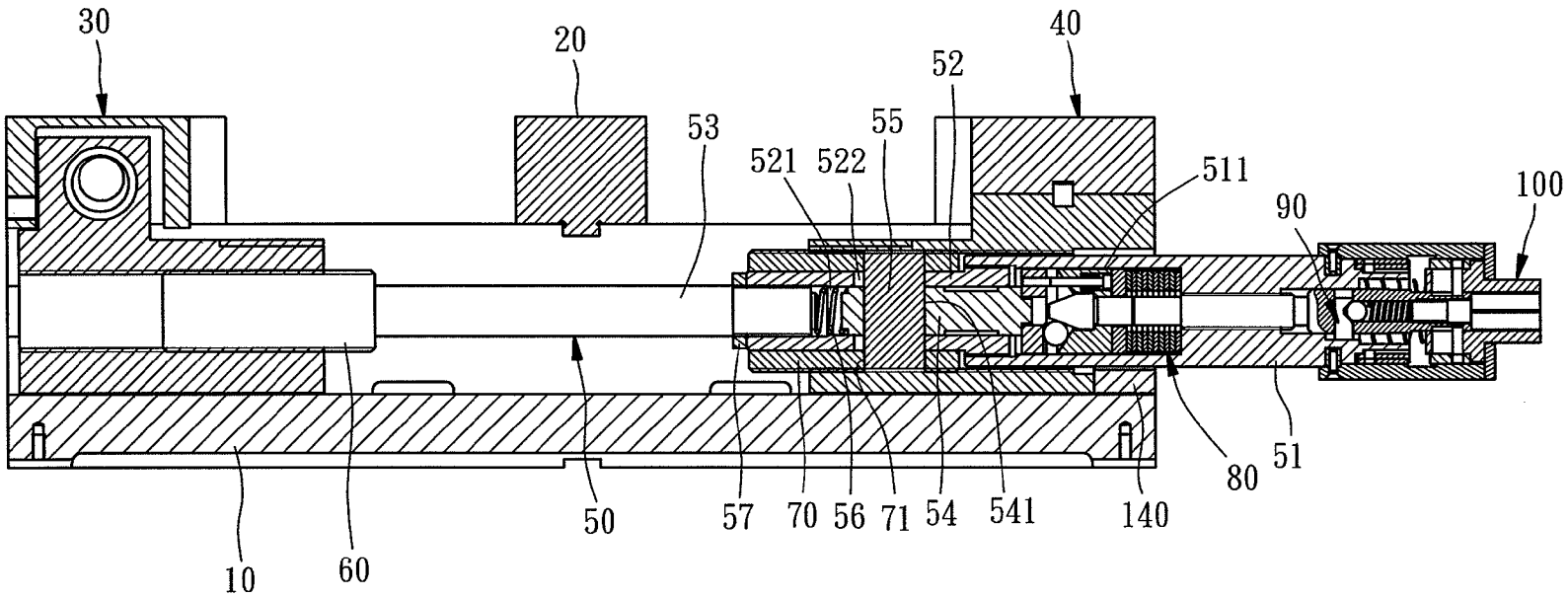
FIG. 2 is a sectional assembly view of the present invention, illustrating the coaxial concentric double jaw vice opened.

Referring to FIGS. 1 and 2, a coaxial concentric double-jaw vice in accordance with the present invention is shown comprising:

a base frame 10 defining a longitudinal sliding groove 11;

a fixed jaw 20 fixedly mounted on the middle of the base frame 10;

two movable jaws 30; 40 mounted on the base frame 10 and movable along the sliding groove 11;

a control rod set 50 inserted through the two movable jaws 30; 40 and received in the sliding groove 11;

a fixed screw rod 60 mounted on the control rod set 50 and screw-connected with one movable jaw 30;

a movable screw rod 70 sleeved onto the control rod set 50 and screw-connected with the other movable jaw 40 and rotatable with the control rod set 50 and movable axially along the control rod set 50 by an external force;

a pressure intensifier 80 mounted on the control rod set 50 and controllable by an external force to expand along the axis of the control rod set 50 and to further move the movable screw rod 70 toward the fixed screw rod 60;

a clutch 90 mounted in the control rod set 50; and a driving mechanism 100 mounted in the control rod set 50 and connectable to the control rod set 50 by the clutch 90 for rotating the control rod set 50 and disconnectable from the control rod set 50 by means of the clutch 90 to drive the pressure intensifier 80.

The control rod set 50 comprises a first rod member 51, a second rod member 52 and a third rod member 53 that are screw-connected with one another in a line. The fixed screw rod 60 is mounted on the third rod member 53 of the control rod set 50. An accommodation chamber 511 is defined in the junction between the first rod member 51 and the second rod member 52 for accommodating the pressure intensifier 80. The second rod member 52 has an axial hole 521 extending axially through the two distal ends thereof, and an elongated slot 522 radially cut through the periphery thereof across the axial hole 521. Further, the aforesaid movable screw rod 70 is a tubular rod member sleeved onto the second rod member 52 of the control rod set 50 and having a radial through hole 71. The control rod set 50 further comprises an inside rod 54 accommodated in the axial hole 521 of the second rod member 52 and having a radial through hole 541, a pin 55 inserted through the radial through hole 71 of the movable screw rod 70 and the radial through hole 541 of the inside rod 54 to secure the movable screw rod 70 to the control rod set 50 for allowing rotation of the movable screw rod 70 with the control rod set 50 synchronously and axial movement of the movable screw rod 70 relative to the control rod set 50 within the extent of the length of the elongated slot 522, a spring member 56 accommodated in the axial hole 521 of the second rod member 52 and stopped between the third rod member 53 and the inside rod 54 and adapted for providing an elastic return force to the inside rod 54 in moving the movable screw rod 70 in direction away from the fixed screw rod 60, and a locknut 57 threaded onto the threaded shank 531 of the third rod member 53 to lock the second rod member 52 and the third rod member 53.

Figure 4:
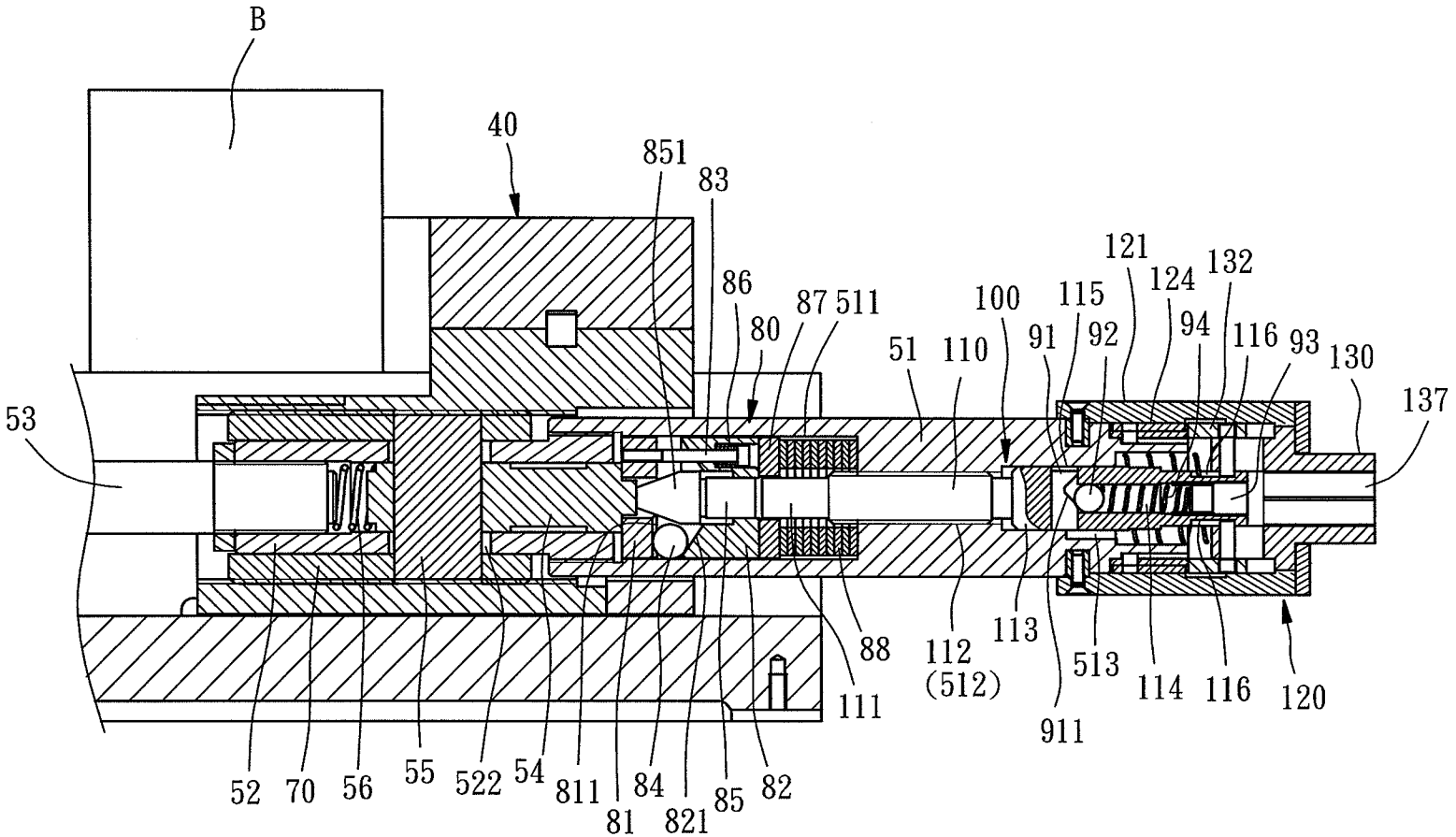
FIG. 4 is a sectional view, in an enlarged scale, of a part of the coaxial concentric double jaw vice in accordance with the present invention, illustrating the pressure intensifier operated.

Referring to FIG. 4, the pressure intensifier 80 comprises a first component 81 stopped against one end of the inside rod 54 and having a groove 811, a second component 82 having a conical face 821, a positioning member 83 inserted into the first component 81 and the second component 82, a steel ball 84 set in between the groove 811 of the first component 81 and the conical face 821 of the second component 82, a plug rod 85 having a conical portion 851 adapted for forcing the steel ball 84 outwards to increase the distance between the first component 81 and the second component 82, a spring member 86 sleeved onto the positioning member 83 and adapted for providing a pressure to force the first component 81 and the second component 82 toward each other, a pressure plate 87 stopped against one end of the second component 82 opposite to the first component 81, and a plurality of spring leaves 88 set in the accommodation chamber 511 of the first rod member 51 and stopped between the pressure plate 87 and the inner end of the accommodation chamber 511 of the first rod member 51.

The driving mechanism 100 comprises a driving rod 110. The driving rod 110 comprises a front extension tip 111 stopped against one end of the plug rod 85 of the pressure intensifier 80, a body portion 113, a threaded stem 112 connected between the front extension tip 111 and threaded into an axial screw hole 512 in the first rod member 51 of the control rod set 50, an accommodation hole 114 axially defined in the body portion 113, a through hole 115 radially cut through the periphery of the body portion 113 in communication with the accommodation hole 113, and two longitudinal grooves 116 longitudinally located on the periphery of the body portion 113.

Figure 5:
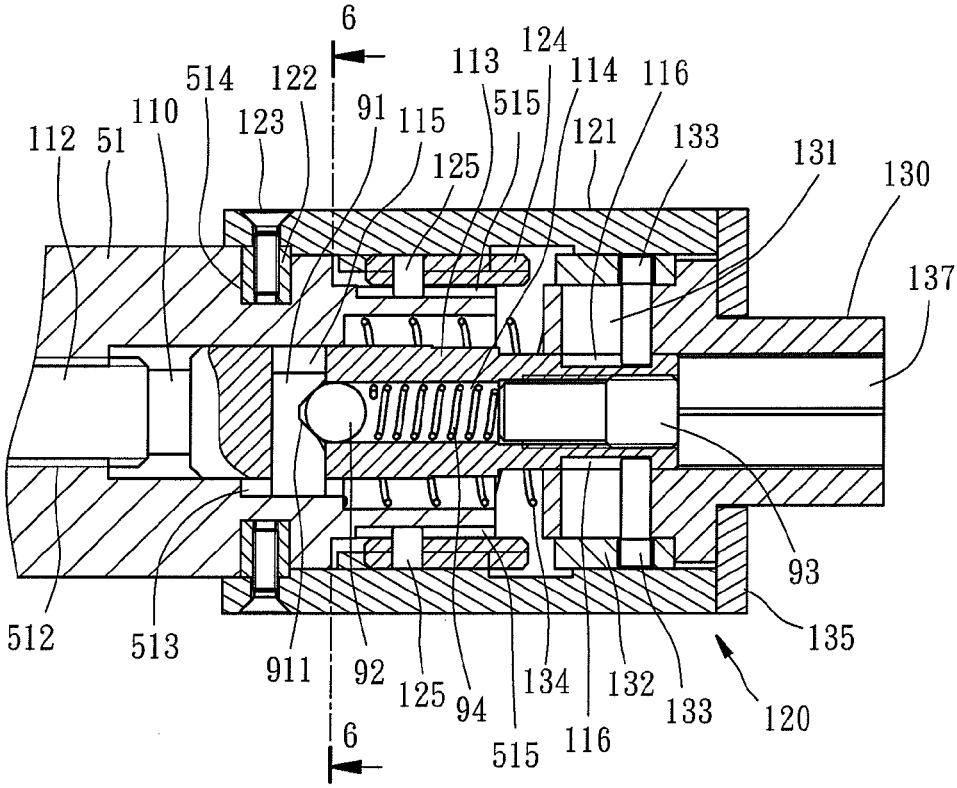
FIG. 5 is a sectional view, in an enlarged scale, of a part of the coaxial concentric double jaw vice in accordance with the present invention, illustrating an adjustment status.
Figure 6:
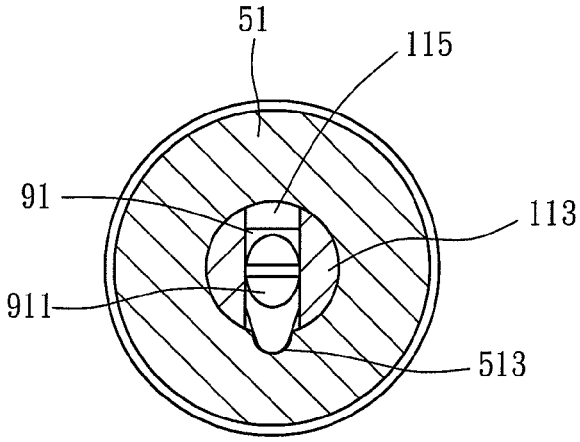
FIG. 6 is a sectional view taken along line 6-6 of FIG. 5.

Referring to FIG. 5 and FIG. 2 again, the clutch 90 is accommodated in the accommodation hole 114 of the driving mechanism 100, comprising a retaining member 91, which is inserted into the through hole 115 of the driving rod 110 and partially extending out of the through hole 115 and engaged into a retaining groove 513 that is located on the inside of the first rod member 51 corresponding to the body portion 113 of the driving rod 110, as shown in FIG. 6, a locating groove 911 located on the retaining member 91, a steel ball 92 accommodated in the accommodation hole 114, an adjustment member 93, for example, adjustment screw, threaded into the accommodation hole 114, and a spring member 94 accommodated in the accommodation hole 114 and stopped between the steel ball 93 and the adjustment member 93. Thus, the steel ball 92 is stopped at the locating groove 911 of the retaining member 91 subject to a set pressure to force the retaining member 91 into engagement with the first rod member 51, allowing synchronous rotation of the control rod set 50 subject to rotation of the driving rod 110. When the control rod set 50 receives a resistance greater than the set pressure during its rotation, the retaining member 91 will be forced to move toward the inside of the through hole 115 and to further force the steel ball 92 toward the inside of the accommodation hole 114, causing disengagement of the retaining member 91 from the retaining groove 513 of the first rod member 51, and therefore the driving rod 110 and the control rod set 50 are disengaged. At this time, the driving rod 110 can be continuously rotated toward the inside of the control rod set 50 to give a pressure to the pressure intensifier 80 without causing rotation of the control rod set 50, thereby moving the movable screw rod 70 slightly toward the fixed screw rod 60 to enhance the chucking effect.

To avoid overpressure and workpiece surface damage, a pressure adjustment mechanism 120 is arranged at an outer side relative to the control rod set 50, as shown in FIG. 5. The pressure adjustment mechanism 120 comprises an adjustment member 121 that is a tubular member rotatably sleeved onto one end of the first rod member 51 and rotatable with two semicircular members 122 that are abutted against each other around an annular groove 514 that extends around the periphery of the first rod member 51, a plurality of screws 123 that affix the adjustment member 121 to the two semicircular members 122, an annular limiter 124 set in between the adjustment member 121 and the first rod member 51 and screw-connected to the adjustment member 121, and two positioning members 125, for example, positioning pins or screws radially mounted in the annular limiter 124 at two opposite sides and respectively projecting into one respective longitudinal groove 515 on the first rod member 51 to guide axial movement of the annular limiter 124 relative to the first rod member 51 and to prohibit rotation of the annular limiter 124 relative to the first rod member 51. Thus, when rotating the adjustment member 121, the limiter 124 is forced to displace, enabling the limiter 124 to directly or indirectly limit the feeding depth of the driving rod 110.

To facilitate operation, the invention further comprises a rotating member 130 that is sleeved onto the body portion 113 of the driving rod 11 and has two elongated through holes 131 respectively disposed corresponding to the two longitudinal grooves 116, a ring 132 sleeved onto the rotating member 130 within the adjustment member 121, two positioning members 133 radially mounted in the ring 132 and respectively inserted through the elongated through holes 131 into the respective longitudinal grooves 116, a spring member 134 stopped between the first rod member 51 and the rotating member 130, and an end cap 135 fastened the outer end of the adjustment member 121 by screws 136 to hold the rotating member 130 in the adjustment member 121 and to let one end of the rotating member 130 extend out of the end cap 135 through a through hole 138 on the end cap 135. Further, the end of the rotating member 130 that extends out of the end cap 135 through the through hole 138 has a hexagonal groove 137. A user can attach a hexagon spanner (not shown) to the hexagonal groove 137 of the rotating member 130, and then operate the hexagon spanner to drive the rotating member 30 in rotating the driving rod 110.

The invention further comprises an auto-positioning mechanism 140. The auto-positioning mechanism 140 comprises a first pressure block 141, a second pressure block 143 and a third pressure block 144 that are elastically outwardly stopped against the longitudinal sliding groove 11 of the base frame 10. The second pressure block 143 and the third pressure block 144 are connected to the movable jaw 40 and axially movable within a predetermined distance and elastically axially stopped against the movable jaw 40. Thus, when surpassed the static friction force between the auto-positioning mechanism 140 and the longitudinal sliding groove 11, the auto-positioning mechanism 140 is movable relative to the longitudinal sliding groove 11. Thus, the auto-positioning mechanism 140 enables the movable jaw 40 to be rapidly released and then chucked.

The operation of the present invention is explained hereinafter.

FIG. 2 illustrates the coaxial concentric double jaw vice fully opened.

Figure 3:
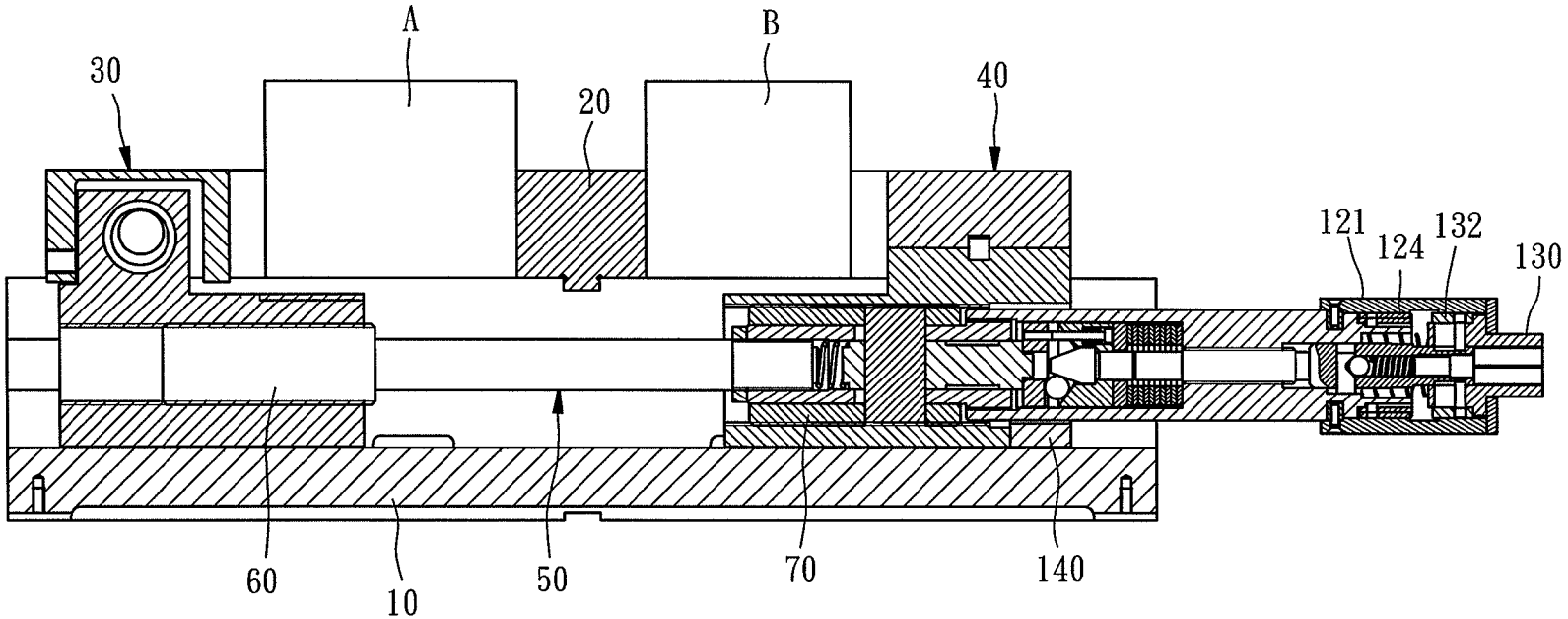
FIG. 3 is similar to FIG. 2 but illustrating two workpieces clamped in the coaxial concentric double jaw vice.

FIG. 3 illustrates coaxial concentric double jaw vice clamped a first workpiece A and a second workpiece B. The fixed screw rod 60 and the movable screw rod 70 have the respective threads extending in reversed directions. Therefore, when the user uses a hand-wheel or spanner (not shown) to rotate the rotating member 130, the control rod set 50 is rotated with the rotating member 130 to move the two movable jaws 30; 40 toward the fixed jaw 20 rapidly, thereby clamping the first workpiece A and the second workpiece B. At this time, the clamping force is not enhanced.

Referring to FIG. 4, when continuously rotating the control rod set 50 after the two movable jaws 30; 40 clamped the workpieces A; B, the resistance received by the control rod set 50 is rapidly increased. When the resistance surpassed the set value, the retaining member 91 is disengaged from the retaining groove 513. At this time, the driving rod 110 is continuously rotatable in the first rod member 51 toward the pressure intensifier 80 subject to the effect of the connection between the threaded stem 112 and the axial screw hole 512. At this time, the front extension tip 111 of the driving rod 110 pushes the plug rod 85 of the pressure intensifier 80 to force the steel ball 84 outwards, thereby increasing the distance between the first component 81 and the second component 82. This action forces the first component 81 to push the inside rod 54 toward the left, thereby causing the pin 55 to move the movable screw rod 70 in carrying the movable jaw 40 leftwards, and therefore the pressure to clamp the workpiece B is intensified. At this time, the spring member 56 is compressed to preserve an elastic return force. When wishing to remove the workpiece B, rotate the rotating member 130 in the reversed direction to move the driving rod 110 rightwards, thereby releasing the pressure intensifier 80. At this time, the spring member 56 is released from the constraint to force the inside rod 54 back to the position in FIG. 3, waiting for a next pressure-intensifying operation.

Referring to FIG. 5, we can rotate the adjustment member 121 to adjust the position of the limiter 124. The position of the limiter 124 shown in FIG. 5 has been moved rightwards when compared to the position shown in FIG. 3. Therefore, when moving the driving rod 110 leftwards, the ring 132 will touch the limiter 124 more quickly when compared to the position shown in FIG. 4, shortening the pressure-intensifying stroke of the driving rod 110 and relatively lowering the extent of the pressure to be intensified.

It is to be understood that the pressure intensifier 80 is not a requisite mechanism of the coaxial concentric double jaw vice. The pressure intensifier 80 can be substituted by: extending the length of the front extension tip 111 of the driving rod 110 or the length of the inside rod 54 of the control rod set 50 and stopping the front extension tip 111 of the driving rod 110 against the inside rod 54 of the control rod set 50, or setting a transfer member (for example, connection rod or cushion block) in between the front extension tip 111 of the driving rod 110 and the length of the inside rod 54 of the control rod set 50.

What is claimed is:

1. A coaxial concentric double-jaw vice, comprising:

a base frame defining a longitudinal sliding groove;

a first movable jaw and a second movable jaw mounted on said base frame and movable along said sliding groove;

a control rod set inserted through said first movable jaw and said second movable jaw and received in said sliding groove;

a fixed screw rod mounted on said control rod set and screw-connected with said first movable jaw;

a movable screw rod sleeved onto said control rod set and screw-connected with said second movable jaw and rotatable with said control rod set and movable axially along said control rod set by an external force;

a clutch mounted in said control rod set;

a driving mechanism mounted in said control rod set and connectable to said control rod set by said clutch for rotating said control rod set; and a pressure intensifier mounted on said control rod set and controllable by an external force to expand along the axis of said control rod set and to further move said movable screw rod toward said fixed screw rod; under a set torque, said driving mechanism is disconnectable from said control rod set by means of the clutch for driving said pressure intensifier;

wherein said movable screw rod is a tubular member sleeved onto said control rod set; said control rod set comprises an elongated slot, a pin inserted through said movable screw rod and said elongated slot to secure said movable screw rod to said control rod set for enabling said movable screw rod to be synchronously rotatable with said control rod set and axially slidable relative to said control rod set within a predetermined distance corresponding to the length of said elongated slot; said pressure intensifier is accommodated in said control rod set and stoppable against said pin to move said movable screw rod toward said fixed screw rod;

wherein said control rod set has a spring member mounted therein and adapted for returning said movable screw rod after said movable screw rod having been moved;

wherein said control rod set comprises a first rod member, a second rod member and a third rod member that are screw-connected with one another in a line; said pressure intensifier is accommodated in said first rod member; said movable screw rod is sleeved onto said second rod member; said elongated slot is formed in said second rod member; said spring member of said control rod set is accommodated in said second rod member; said fixed screw rod is installed in said third rod member;

wherein the control rod set includes an inside rod accommodated in an axial hole of the second rod member and having a radial through hole, the pin inserted through the radial through hole of the movable screw rod and the radial through hole of the inside rod, the spring member accommodated in the axial hole of the second rod member and stopped between the third rod member and the inside rod for providing an elastic return force to the inside rod in moving the moveable screw rod in a direction away from the fixed screw rod, and a locknut threaded onto a threaded shank of the third rod member to lock the second rod member and the third rod member; and wherein upon actuation of the pressure intensifier, the inside rod is moved, causing the pin to move the movable screw rod in carrying the second movable jaw, so that the clamping force is intensified and the spring member is compressed to preserve an elastic return force.

2. The coaxial concentric double-jaw vice as claimed in claim 1, wherein said driving mechanism comprises a driving rod accommodated in said control rod set; said clutch is set in between said driving rod and said control rod set, comprising a retaining member and a spring member.

3. The coaxial concentric double-jaw vice as claimed in claim 2, wherein said driving rod comprises an accommodation hole axially defined therein, a steel ball accommodated in said accommodation hole; a through hole radially cut through the periphery thereof in communication with said accommodation hole; said retaining member is accommodated in the through hole of said driving rod; said spring member of said clutch is stopped against said steel ball in said accommodation hole; said control rod set comprises a retaining groove adapted for receiving said retaining member.

4. The coaxial concentric double-jaw vice as claimed in claim 3, wherein said driving rod comprises a front extension tip stopped against one end of said pressure intensifier, a body portion, a threaded stem connected between said front extension tip and threaded into an axial screw hole in said first rod member of said control rod set; said clutch is mounted in said body portion of said driving rod.

5. The coaxial concentric double-jaw vice as claimed in claim 4, further comprising a pressure adjustment mechanism arranged at an outer side relative to said control rod set and adapted for limiting the feeding of said driving rod.

6. The coaxial concentric double-jaw vice as claimed in claim 5, wherein said pressure adjustment mechanism comprises an adjustment member rotatably sleeved onto one end of said control rod set, an annular limiter set in between said adjustment member and said first rod member and axially movable with said control rod set and rotatable with said control rod set and screw-connected with said adjustment member; said driving rod is directly or indirectly stoppable against said limiter.

7. The coaxial concentric double-jaw vice as claimed in claim 6, further comprising a rotating member disposed at an outer side of said driving rod for the connection of an external handwheel or spanning tool to rotate said driving rod, said rotating member being movable axially along said driving rod and synchronously rotatable with said driving rod and directly or indirectly stoppable against said limiter.

8. The coaxial concentric double-jaw vice as claimed in claim 1, further comprising at least one auto-positioning mechanism axially movably connected to said at least one said movable jaw, said auto-positioning mechanism being stopped against said longitudinal sliding groove of said base frame and movable relative to said longitudinal sliding groove when surpassed the static friction fore.

9. The coaxial concentric double-jaw vice as claimed in claim 1, further comprising a fixed jaw fixedly mounted on a middle part of said base frame.

* * * * *